US005113982A

United States Patent [19]

Pulichino et al.

[11] Patent Number: 5,113,982

[45] Date of Patent: May 19, 1992

[54] GARMENT BAG WITH WHEELS AND AN INNER PANEL WITH PLURAL ACCESS OPENINGS

[75] Inventors: John Pulichino, Providence, R.I.; Joy Tong, New York, N.Y.

[73] Assignee: American Tourister, Inc., Warren, R.I.

[21] Appl. No.: 653,182

[22] Filed: Feb. 11, 1991

[51] Int. Cl.[5] ..... A45C 5/14; A45C 5/12; A45C 13/10

[52] U.S. Cl. ..... 190/18 A; 190/109; 190/112; 190/119; 190/903; 206/287.1; 206/291; 206/292

[58] Field of Search ..... 190/109-112, 190/119, 115, 903; 206/287, 287.1, 289, 292, 291

[56] References Cited

U.S. PATENT DOCUMENTS

| | | | |
|---|---|---|---|
| 2,261,291 | 11/1941 | Salavsky | 206/287.1 X |
| 2,453,663 | 11/1948 | Hinson | 206/287.1 X |
| 2,705,063 | 3/1955 | Torrent | 190/111 |
| 2,717,671 | 9/1955 | Arnold et al. | 190/119 |
| 3,315,772 | 4/1967 | Katz | 206/287.1 |
| 3,933,229 | 1/1976 | Pelavin | 190/111 X |
| 4,693,344 | 9/1987 | Shuler | 190/903 X |
| 4,753,342 | 6/1988 | Pulichino, Jr. et al. | 206/292 X |
| 4,825,985 | 5/1989 | Kim | 206/287.1 X |
| 4,898,274 | 2/1990 | Stout et al. | 190/903 X |
| 4,998,603 | 3/1991 | Nortstrom | 190/111 X |

FOREIGN PATENT DOCUMENTS

| | | | |
|---|---|---|---|
| 117830 | 11/1943 | Australia | 190/119 |
| 629153 | 10/1961 | Canada | 190/115 |
| 626557 | 10/1961 | Italy | 206/289 |
| 437876 | 11/1935 | United Kingdom | 190/109 |
| 1152669 | 5/1969 | United Kingdom | 190/119 |

*Primary Examiner*—Sue A. Weaver
*Attorney, Agent, or Firm*—Wood, Herron & Evans

[57] ABSTRACT

A garment bag including inner and outer panels, a pair of sides and ends joined together and joined to the outer panel defining an interior packing space, the inner and outer panels being foldable along a central axis such that the bag can be moved from a folded position and an unfolded position providing access to the inner packing space. The inner panel is divided into two separate sections either of which may be zipped and unzipped independent of the other to provide access to the inner packing space.

5 Claims, 3 Drawing Sheets

GARMENT BAG WITH WHEELS AND AN INNER PANEL WITH PLURAL ACCESS OPENINGS

This invention relates to a garment bag and, more particularly, to a garment bag having in an open position access to an interior packing space through two distinct panel sections.

BACKGROUND OF THE INVENTION

Garment bags typically in use today include inner and outer fabric, e.g., nylon, panels; integral, sides and ends joined to the outer panel; and a zippered connection joining the inner panel to the sides and an end thereby defining an interior packing space therebetween. The inner panel zipper typically runs along the two sides and the top or hanger end with the inner panel being permanently sewn along and to the bottom or opposite end. The garment bag is movable between an open position wherein the the inner and outer panels lie generally flat, and the inner fabric panel may be unzipped providing access to the interior packing space for packing of clothes and other items therein. Further in the open position, the garment bag can be suspended by a hook attached to one end of the bag from a rack or a closet hanger rod or pole.

In the closed position, the garment bag is folded upon its self to provide a compact bag for traveling. Typically, a zipper extends around the sides and ends of the bag adjacent the inner panel whereby the bag may be securely zipped closed for traveling. Such bags further typically include a handle on the outer panel which may be grasped for carrying the bag in the closed position.

As described above and as is known, in the unfolded or open position of the bag, it is generally necessary to fully unzip the inner panel to gain access to the interior of the bag for packing and unpacking of clothing and other articles. Thus, a relatively long panel which may be on the order of 4' in length hangs down from one end of the bag. This panel section may be considered both heavy and cumbersome.

SUMMARY OF THE INVENTION

In accordance with a presently preferred form of this invention, a garment bag is provided including inner and outer panels, a pair of sides and ends joined together and joined to the outer panel defining an interior packing space. The inner and outer panels, which may be formed of a suitable material such as nylon, are foldable along a generally central axis extending between the sides midway between the ends so that the bag can be moved between a folded position wherein the inner and outer panels are folded over on themselves, and an unfolded position wherein the inner and outer panels lie generally flat for packing or hanging of the garment bag from a rack or a rod or pole in a closet. The inner panel is divided into two distinct and separate sections. Each section is joined by stitching for example to one of the sides or an end of the bag. A central partition extends between the sections along the fold axis of the bag and separates the two inner panel sections. A zipper extends around the two unattached sides or ends of the bag and along either side of the central partition providing a three-sided closure to each of the two inner panel sections.

Accordingly, and in accordance with the principles of this invention, either section may be opened and closed independently of the other. Thus, for example, when the bag is hanging in a closet either the top or bottom section may be opened independent of the other to provide access to the interior of the bag as desired. Further however, even when both panel sections are unzipped the length of material hanging from the bag, e.g., from the bottom, is only half of what it otherwise would be.

The garment bag of the present invention further includes a variety of packing compartments and other features.

DETAILED DESCRIPTION OF THE INVENTION

Figure 1:
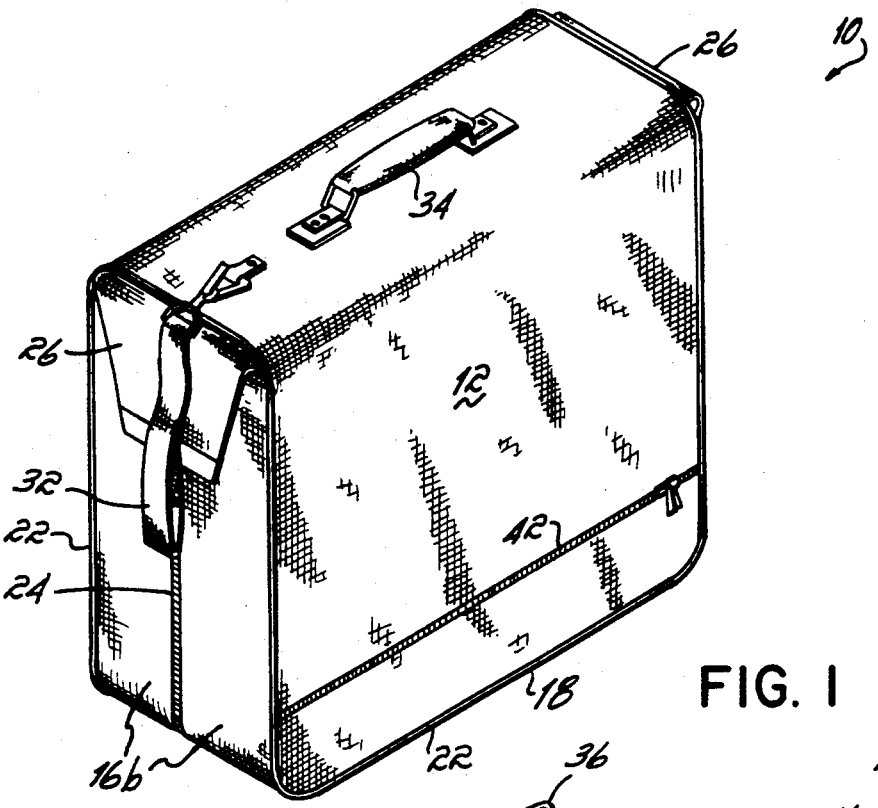
FIG. 1 is an isometric pictorial view of the garment bag of the present invention in the folded position.
Figure 2:
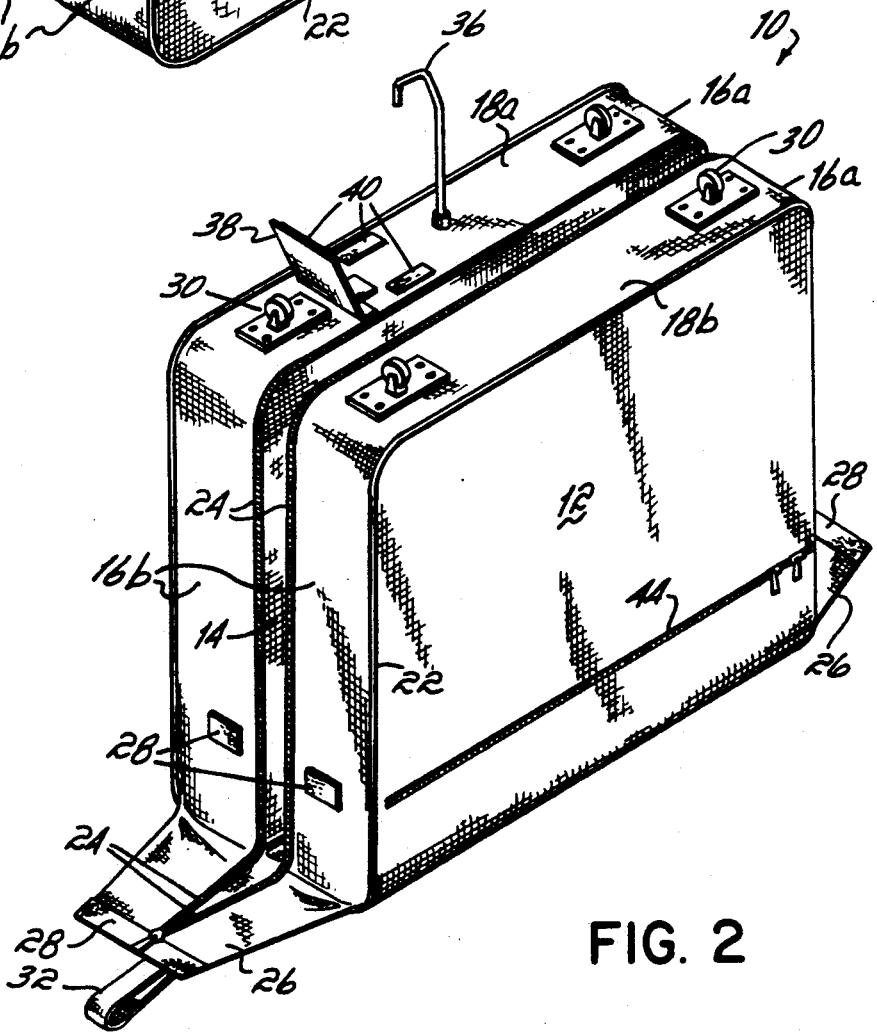
FIG. 2 is an isometric pictorial view of the bottom of the bag shown in FIG. 1 substantially in the folded position but unzipped.
Figure 4:
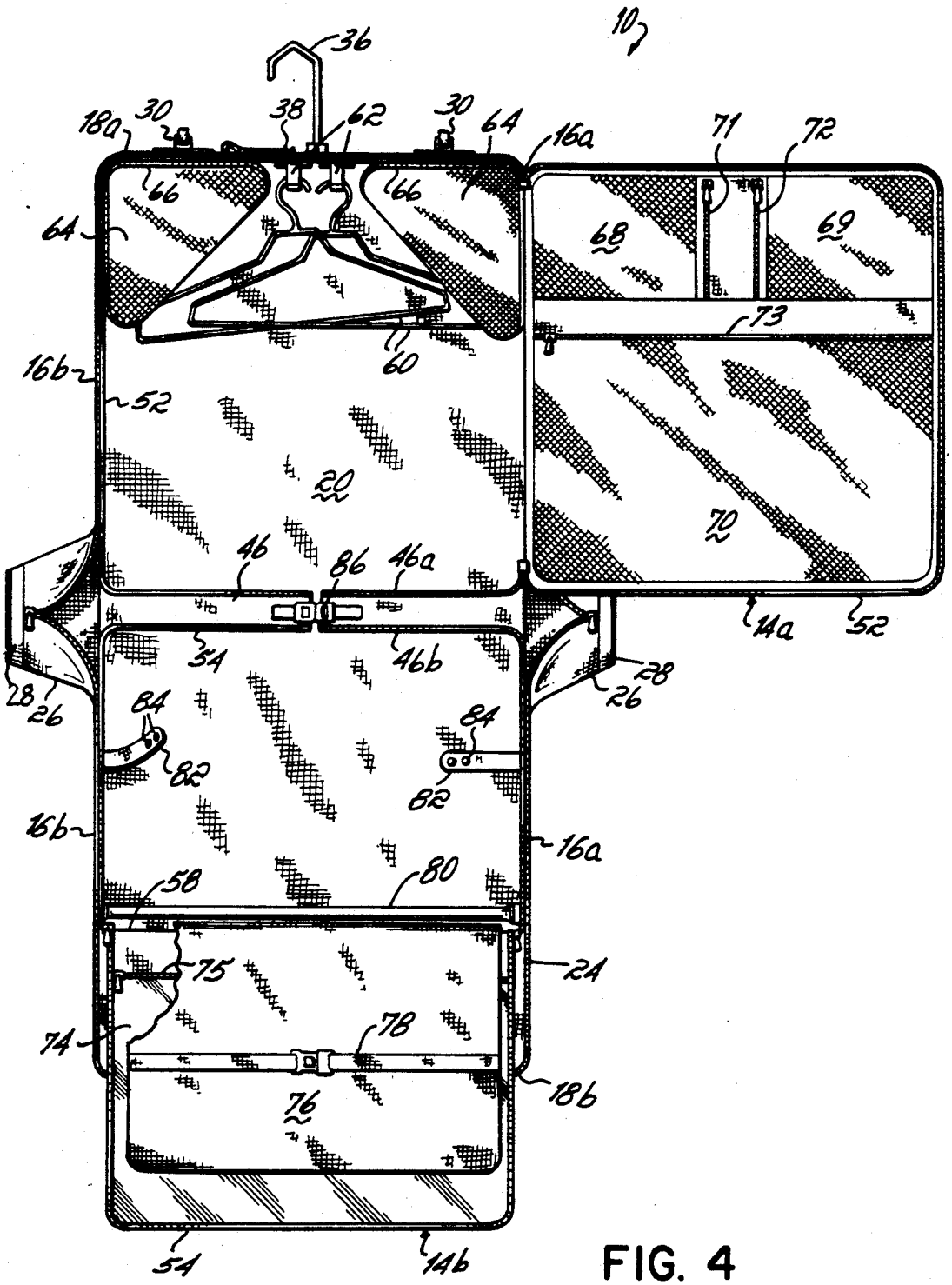
FIG. 4 is a plan view of the bag shown in FIG. 3 but with the inner panel sections unzipped to provide access to the inner packing space.

Referring now to FIGS. 1 and 2, the garment bag 10 of the present invention includes an outer panel 12, an inner panel 14, a pair of sides 16*a*, 16*b* and integral ends 18*a*, 18*b*. The inner 12 and outer 14 panels are formed of a suitable fabric material such as nylon and are flexible whereby the bag 10 may be folded in half as shown in FIG. 1 for traveling. The sides 16*a*, 16*b* and ends 18*a*, 18*b* are generally rigid and of a width on the order of several inches, e.g., 4 inches, defining therebetween an interior packing space 20, as best seen in FIG. 4. The outer panel 12 is secured to the sides 16*a*, 16*b* and ends 18*a*, 18*b*, for example, by stitching along an edge 22. Ends 18*a*, 18*b* meet in the folded condition of the bag to form a bottom 18.

Figure 3:
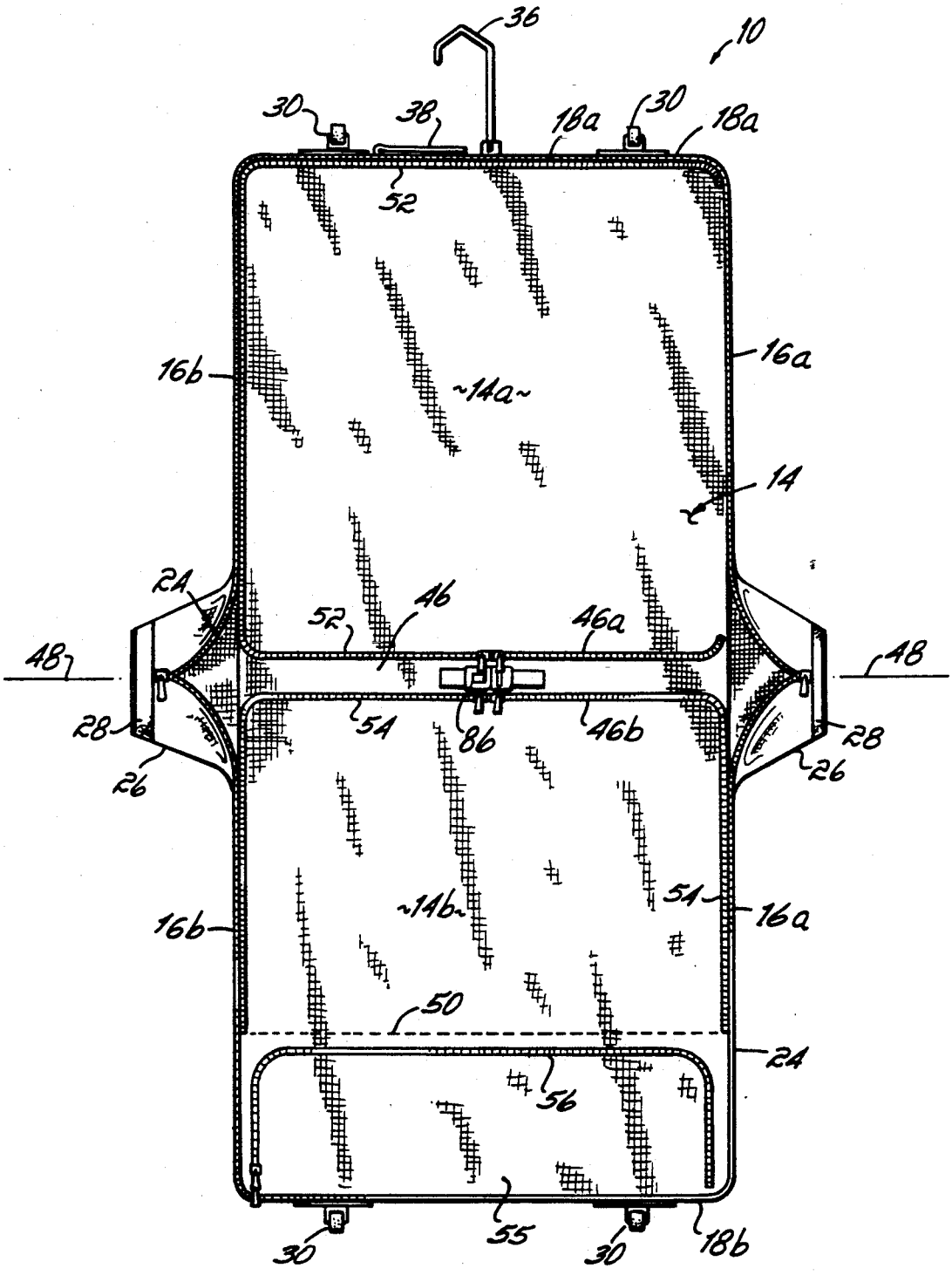
FIG. 3 is a plan view of the interior of the bag in the unfolded position with the inner panels in place and the interior packing space closed.

A zipper 24 extends around the sides 16*a*, 16*b* and ends 18*a*, 18*b* and along a pair of edge flaps 26 which permit the bag to be zippered closed in the folded position (FIG. 1) and unzipped and laid flat in the unfolded position (FIG. 3). The zipper 24, as all zippers hereinafter referred to, is preferably the double-acting type whereby the bag may be zipped and unzipped from either or both ends. Mating Velcro tabs 28 attached to the edge flaps 26 and the sides 16*a*, 16*b* of the bag 10 secure the edge flaps 26 to the sides 16*a*, 16*b* of the bag 10 in the closed position (FIG. 1).

Wheels 30 may be provided on the ends 18*a*, 18*b* of the bag 10 such that the bag 10 may be pulled by a pull strap 32 attached to the outer panel 12 and roll on the wheels 30. A handle 34 is attached to the outer panel 12 for grasping and lifting the bag 10. A hook 36 is provided on one end 18*a* of the bag 10 to permit suspending of the bag 10 from a rack or closet rod or pole in the orientation shown in FIG. 3. A hook closure flap 38, which again may be secured closed by mating Velcro tabs 40, secures the hook 36 close to the end 18*a* so that the hook 36 is out of the way and does not dangle during traveling.

The outer side 12 of the bag may include pockets which are accessible by zippers 42, 44 for packing of articles therein.

Referring now to FIG. 3, the inner panel 14, which may likewise be formed of a suitable fabric such as nylon, extends between the opposite sides 16*a* and 16*b* and at least one end 18*a* and closes the interior packing space 20. The inner panel 14 includes a first section 14*a*, a second section 14*b*, and a central partition 46 extending between the sides 16*a*, 16*b* generally along the fold axis 48 (dotted) of the bag 10. The partition 46 separates the first 14*a* and second 14*b* sections. In a presently preferred form of the invention, the first section 14*a* is secured along one side 16*a* of the bag 10, for example, by stitching. The second section 14*b* is secured along an end 50 extending between the sides 16*a*, 16*b*. A double-acting zipper 52 extends continuously between the first section 14*a* and one end 18*a*, one side 16*b*, and one side 46*a* of the central partition 46 permitting the first section 14*a* to be unzipped to provide access to a portion of the inner packing space 20 underlying the first section 14*a*, as seen in FIG. 4.

A second zipper 54 extends along two sides 16*a*, 16*b* and along the other side 46*b* of the central partition 46 permitting the second section 14*b* to be unzipped providing access to the remaining portion of the inner packing space 20. It will be recognized, however, that the two panel sections 14*a*, 14*b* could be joined to either side or to an end of the bag as desired.

In the embodiment shown in FIGS. 3 and 4, the second section 14*b* is conveniently hinged along a line 50 running between the sides 16*a* and 16*b* and spaced from the end 18*b*. A compartment 55 lies between adjacent end 18*b* and line 50 and includes a zipper 56 for opening and closing the pocket 55. The pocket 55 has an inner wall 58 (FIG. 4) extending between the outer 12 and inner 14*b* panels separating it from packing space 20 such that articles may be placed therein and not come into contact with clothing in space 20.

The interior 20 of the bag 10 includes hangers 60 which may be releasably attached by means of hanger hooks 62 attached to one end 18*a* of the bag 10 for hanging clothes therefrom in space 20. Triangular corner pockets 64, which may be either permanently or releasably attached to the end 18*a* and sides 16*a*, 16*b*, include zippers 66 for opening and closing of the pockets 64 for packing articles in the corners of the space 20.

The first panel section 14*a* includes on its side facing packing space 20 three pockets 68, 69, 70 having a mesh fabric on the inner side for receiving clothing and other articles. Each pocket is openable and closable by means of a separate zipper 71, 72, 73, respectively. The second panel section 14*b* includes a pocket 74 on the inner side thereof which likewise is openable and closable by means of a zipper 75. A relatively more rigid interior panel 76 is attached to the bag 10 and may be folded in and out of space 20. One side of the interior panel 76, as shown in FIG. 4, includes an elastic strap 78 for securing the ends of clothing placed on hangers 60 of extended length such as dresses and coats against the panel 76. In this connection, a releasable rod 80 extends between the sides 16*a*, 16*b* of the bag 10 which may then overlie the dresses or coats extending from space 20 and onto panel 76 thereby providing a rod about which the extended length clothing may be folded back upon itself into the interior packing space 20 when panel 76 is folded back over space 20. Side straps 82 attached to the sides 16*a*, 16*b* include snaps 84 which secure the panel 76 in this inwardly folded position. Although not shown in the drawings, the opposite side of the panel 76 may include pockets as are known in the art for packing of shoes.

The central partition 46 is divided in half at its midpoint and includes a latch 86 permitting the partition 46 to be separated and swung outwardly providing unrestricted access to the interior packing space 20. When the clothes are fully packed in space 20, e.g., on hangers 60, the central partition 46 may be folded across the packing space 20 and secured together by means of the latch 86. The panel 76 may be swung inwardly and secured by means of the side straps 82. The second inner panel section 14*b* may be folded over the packing space 20 and zipped closed along the two sides 16*a* and 16*b* and the one side 46*b* of the central partition 46. The first inner panel section 14*a* may be swung over the packing space 20 and zipped shut along the end 18*a*, side 16*b*, and the side 46*a* of the central partition to fully close the packing space 20, as shown in FIG. 3. When the bag 10 is packed and closed as shown in FIG. 3, it may then be folded upon itself and zipped shut by means of the zipper 24 to provide the compact carrying bag in the configuration shown in FIG. 1.

Referring back to FIGS. 3 and 4, it may be seen that bag 10 may be suspended from the hook 36, and either panel section 14*a*, 14*b* may be opened or closed independent of the other, as may be desired.

Thus having described the invention what is claimed is:

1. A garment bag comprising:

a foldable inner panel, a foldable outer panel, and a pair of sides and ends joined to said outer panel defining an interior packing space, said inner and outer panels being foldable along an axis extending between said sides generally midway between said ends whereby said bag can be in either a folded position wherein the inner panel is folded over an itself or an unfolded position whereby said inner and outer panels lie generally flat, said inner panel comprising:

a first section joined to one of said sides and one end of said bag, a second section joined to one of said sides and the other end of said bag, and a central partition attached to and extending between said sides along said axis, said central partition further comprising means for selectively latching and unlatching said central partition, said first and second sections being generally equally dimensioned and separated by said central partition, and first and second zippers extending along opposite sides of said central partition and along said first and second sections, respectively, permitting each of said sections to be opened and closed independently of the other for opening and closing of said interior packing space.

2. The garment bag of claim 1 further comprising:

a third zipper extending around said sides and ends for closing said bag in the folded position.

3. The garment bag of claim 1 wherein said central partition is split generally midway of said sides and further comprises a latch for selectively latching and unlatching said central partition.

4. The garment bag of claim 1 further comprising:

a relatively rigid interior panel hinged to the garment bag and underlying said second inner panel section in said interior packing space, said interior panel including an elastic strap for securing clothes thereon on the side opposite said second inner panel section and means for securing said interior panel in said interior packing space.

5. A garment bag comprising:

a foldable inner panel, a foldable outer panel, a pair of sides and ends joined to said outer panel defining an interior packing space, said inner and outer panels being foldable along an axis extending between said sides generally midway between said ends whereby said bag can be in either a folded position wherein the inner panel is folded on itself or an unfolded position wherein said inner and outer panels lie generally flat, a hanger hook attached to one of said ends, means for selectively securing and releasing said hanger hook, a zipper extending around said sides and ends for closing said bag in the folded position, said sides including side flaps permitting said bag to be laid flat when said zipper is unzipped, means for securing said side flaps to said sides in the bag folded position, said outer panel further comprising pockets therein and a handle attached to said outer panel, wheels attached to said ends permitting rolling of said garment bag in the bag folded position, said inner panel comprising:

a first section joined to one of said sides of said bag, a second section joined to the end of said bag opposite said end having said hanger hook, a central partition attached to and extending between said sides along said axis, said central partition being split in the middle and including latch means for selectively securing and releasing said partition, said first and second sections being generally equally dimensioned and separated by said central partition, first and second zippers extending along opposite sides of said central partition and along said first and second sections, respectively, permitting each of said sections to be opened and closed independently of the other for opening and closing of said interior packing space, a pair of triangular shaped corner pockets disposed in said interior packing space in the corners between said sides and said end carrying said hanger hook, latch means attached interiorly to the end of said bag carrying said hanger hook for holding clothes hangers, a relatively rigid interior panel underlying said second inner panel section and being hinged to permit movement of said interior panel in and out of said interior packing space, said interior panel further comprising an elastic strap for securing clothes thereto, side straps for securing said interior panel in said interior packing space, said first inner panel section including pockets on the side thereof facing said interior packing space, and said second panel section including a pocket on the side thereof facing said interior packing space, said pockets being openable and closable by zippers.

* * * * *